US006067071A

United States Patent [19]

Kotha et al.

[11] Patent Number: 6,067,071

[45] Date of Patent: May 23, 2000

[54] METHOD AND APPARATUS FOR EXPANDING GRAPHICS IMAGES FOR LCD PANELS

[75] Inventors: Sridhar Kotha, Fremont; Vlad Bril, Campbell; Alexander J. Eglit, Half Moon Bay; Robin Sungsoo Han, Saratoga, all of Calif.

[73] Assignee: Cirrus Logic, Inc., Fremont, Calif.

[21] Appl. No.: 08/673,793

[22] Filed: Jun. 27, 1996

[51] Int. Cl.[7] ..... G09G 3/36

[52] U.S. Cl. ..... 345/132; 345/127; 345/213

[58] Field of Search ..... 345/3, 132, 133, 345/213, 127, 87; 348/581

[56] References Cited

U.S. PATENT DOCUMENTS

| | | | |
|---|---|---|---|
| 4,725,892 | 2/1988 | Suzuki et al. | 358/287 |
| 4,827,347 | 5/1989 | Bell | 358/224 |
| 4,845,482 | 7/1989 | Howard et al. | 340/805 |
| 4,866,520 | 9/1989 | Nomura et al. | 358/140 |
| 4,870,661 | 9/1989 | Yamada et al. | 375/122 |
| 5,140,532 | 8/1992 | Beckwith, Jr. et al. | 345/133 |
| 5,179,345 | 1/1993 | Jenkins et al. | 324/678 |
| 5,182,633 | 1/1993 | Antonio et al. | 358/11 |
| 5,233,331 | 8/1993 | Comerford et al. | 340/712 |
| 5,254,982 | 10/1993 | Feigenblatt et al. | 345/148 |
| 5,266,933 | 11/1993 | Frank et al. | 345/141 |
| 5,270,687 | 12/1993 | Killebrew, Jr. | 345/150 |
| 5,274,372 | 12/1993 | Luthra et al. | 341/61 |
| 5,287,100 | 2/1994 | Guttag et al. | 345/213 |
| 5,293,468 | 3/1994 | Nye et al. | 395/131 |
| 5,294,984 | 3/1994 | Mori et al. | 358/160 |
| 5,302,985 | 4/1994 | Kennedy et al. | 353/122 |
| 5,309,551 | 5/1994 | Guttag et al. | 395/131 |
| 5,327,159 | 7/1994 | Van Aken et al. | 345/153 |
| 5,341,470 | 8/1994 | Simpson et al. | 395/164 |
| 5,345,268 | 9/1994 | Matsuta et al. | 348/384 |
| 5,351,087 | 9/1994 | Christopher et al. | 548/441 |
| 5,400,057 | 3/1995 | Yin | 345/199 |
| 5,408,269 | 4/1995 | Tsukagoshi | 348/416 |
| 5,436,636 | 7/1995 | Nonoshita et al. | 345/100 |
| 5,481,275 | 1/1996 | Mical et al. | 345/132 |
| 5,508,714 | 4/1996 | Zenda | 345/3 |
| 5,508,747 | 4/1996 | Lee | 348/441 |
| 5,706,035 | 1/1998 | Tsunoda et al. | 345/213 |

*Primary Examiner*—Steven J. Saras
*Assistant Examiner*—John G. Lim
*Attorney, Agent, or Firm*—Robert P. Bell; Kile McIntyre Harbin & Lee

[57] ABSTRACT

A display controller in a computer system controls the output of graphics display data in a computer system having a fixed resolution flat panel display. Fixed panel displays may have problems displaying non-native resolutions particularly at lower resolutions. The controller of the present invention uses a Discrete Time Oscillator (DTO) based clock divider and DCT based polyphase interpolation to upscale graphics display data from a first resolution to the panel resolution. DTO clock divider circuit synchronizes scan clocks between the input resolution and the desired output resolution. Within graphics display area, MVA™ display at greater color depth and resolution may be accommodated by additional DTO divider and interpolation steps.

11 Claims, 5 Drawing Sheets

METHOD AND APPARATUS FOR EXPANDING GRAPHICS IMAGES FOR LCD PANELS

FIELD OF THE INVENTION

The present invention is in the field of portable computers, namely laptop, notebook, or similar portable computers with flat panel displays with or without SIMULSCAN™ capability. In particular, the present invention relates to displaying graphics data on fixed resolution LCD panel displays.

BACKGROUND OF THE INVENTION

Popularity of portable computer systems has driven computer designers to integrate more processing power, more memory capacity, and more peripherals into a single portable unit. Advances in core logic, a term known in the art to comprise support logic, and other common circuitry integrated into a chip or chipset, allows more functionality to be placed in smaller, lighter packages.

A primary element of a portable computer system is a display. Since Cathode Ray Tube (CRT) displays are relatively large and heavy, with high power requirements, other alternatives have actively been sought. Flat panel display technology represents a significant alternative to CRT display technology. Flat panel displays may have several advantages over CRT displays. Flat panel displays comprise active or passive Liquid Crystal Displays (LCD) displays, field-emission displays, plasma displays, electroluminescent displays, and many others all available in a wide variety of sizes and sub-types. LCD units have been a flat panel design choice of preference in most systems. LCD displays may have advantages of being compact and relatively flat, consuming little power, and in many cases displaying color. Typical disadvantages of LCD displays may be poor contrast in bright light—especially bright natural light, inconsistent performance in cold temperatures, and display resolutions which may be constrained by a fixed number of row elements and column elements. Among these limitations, fixed resolution may cause significant problems for LCD operation in a multimedia environment.

Flat panel displays may typically comprise two glass plates pressed together with active elements sandwiched between. High resolution flat panel displays use matrix addressing to activate pixels. Conductive strips for rows may be embedded on one side of a panel and similar strips for columns are located on the other side. Panels may be activated on a row by row basis in sequence. This process may described in more detail in a text entitled: "High Resolution Graphics Display Systems", Peddie 1994 (p. 191–225), incorporated herein by reference, however the general nature of LCD addressing is known in the art.

LCD flat panel display resolution may be dictated by physical construction of an LCD. CRT displays have a continuous phosphor coating and may be illuminated by an analog signal driving an electron beam. Because of the analog nature of CRT displays virtually any point on the CRT screen may be illuminated, thus scaling display resolution is relatively simple. LCD displays have a fixed array of physical pixels which may be turned on or off by applying or removing a charge. While resolution of a CRT may be changed by changing display modes and corresponding scanning frequency parameters, LCDs are limited by number of row and column elements used to manufacture an LCD device. Fixed resolution in LCD displays is particularly troublesome in multimedia systems which may require changes in display resolution to take full advantage of applications displaying high resolution graphics. In addition, for a manufacturer of display controllers to claim full VGA, SVGA, and XGA compatibility limitations of fixed panel resolution must be overcome.

TABLE 1

Vertical scanning frequencies for different graphics display modes

| | | |
|---|---|---|
| VGA Panel | 640 × 480 | 25 MHz |
| SVGA Panel | 800 × 600 | 40 MHZ |
| XGA Panel | 1024 × 768 | 65 MHZ |

Like an analog CRT, an LCD panel may be controlled by a horizontal and vertical scanning signal. Data may be displayed in its respective screen position during an interval in time corresponding to when vertical and horizontal scan signals for a particular location coincide. Vertical scan signals are set at a frequency proportional to display resolution. Table 1 contains the vertical scanning frequencies for popular graphics display modes. Typical vertical scanning frequencies may be 25 MHz for 640 pixel by 480 pixels display, 40 MHz 800 by 600, 65 MHz 1024 by 768. New panels comprising 1280 by 960 pixels may have an even higher vertical scanning frequency. A high resolution display therefore may have a higher scanning frequency than a relatively lower resolution display. Using the general principal stating high frequency is proportional to high resolution, some downscaling may be achieved by attempting to replicate lower scanning frequencies of low resolution display while maintaining native scanning resolution. On a fixed resolution display of say 600 by 800 pixels, a 640 by 480 resolution output may be scaled by lowering the frequency at which data is clocked to the display.

Most multimedia computers have the ability to select from one of several display resolutions. Common display resolutions may be 640 pixels by 480 pixels, 600 pixels by 800 pixels, and 1024 pixels by 768 pixels. A standard fixed resolution LCD display may be 600 pixels by 800 pixels. A standard universal VGA resolution may be 640 pixels by 480 pixels with 256 colors. When a low graphic resolution must be displayed on a fixed resolution LCD display certain problems may arise. To properly display all VGA modes in a portable computer environment with a fixed resolution LCD panel display, desired graphics resolution must be scaled to the panel resolution. Fewer problems are inherent in downscaling, when desired display resolution is larger than the panel. Upscaling however may present special problems.

When attempting to display lower resolution graphics on higher resolution, fixed resolution panel displays a variety of compensation methods may be used. Compensation features may be made available through use of shadow registers and extension registers. Both compensation method and desired parameters, such as output resolution may be set through use of registers.

Some systems employ a compensation technique known as centering. With centering, smaller resolution graphics are placed within a larger resolution display in the center of the display. One problem associated with centering a 640 by 480 display at full color within, for example, a 1024 by 768 display is limited bandwidth. Another problem with centering and prior art expansion techniques is the scope of programming required to support it. Many shadow registers must be programmed, and protection mechanisms must be in place to configure and then preserve the expanded display settings.

FIG. 2 is a diagram illustrating a prior art technique of centering. During centering, Graphics Window 200 with a resolution of 640 pixels by 480 pixels may be displayed on Fixed Resolution Panel 201 which is capable of displaying at a fixed resolution of 1024 pixels by 768 pixels. Graphics Window 200 may be generated by a software application such as a computer game with high resolution graphics. For consistency and compatibility purposes, such a computer game may generate a display with a resolution of 640 pixels by 480 pixels regardless of the resolution capability of the display.

Differences in size must be accommodated to physically center a smaller display within a larger resolution panel. Additionally, differences in normal VGA timing which may be around 25 MHz, and native timing of an LCD panel which, for a 1024 pixel by 768 pixel display, may be around 65 MHz must be accommodated. In other words, during centering, a panel must actively accommodate the difference between lower resolution graphics mode and higher resolution panel by generating blank pixels. The resulting display is often too small to be viewed acceptably. For a 1024 by 768 pixel panel there may be 9 or 10 inches of display surface of which one third may go unused during centering. Not only does this waste the capability of the panel, it is often too small to read text either in Windows™ or in DOS text mode.

Another compensation technique for vertical scaling is known as line replication. In line replication or stretching, every Nth line may be duplicated on a subsequent line. In text mode, only blank line insertion may be used to evenly fill an entire panel.

Yet another problem arises when attempting to drive two display devices with different display resolutions through a SIMULSCAN™ output. If Microsoft™ Windows™ is running, a dual display mode may be activated by way of an icon as is done for SIMULSCAN™ displays. Requests may then be passed by Windows™ Graphic Driver Interface (GDI) to appropriate display driver and hardware. Only one graphics resolution, however, may be selected for one or both displays at one time. In other words, separate display resolutions may not be desirable for each display in a particular SIMULSCAN™ environment. Thus, on a notebook system with an 800 pixel by 600 pixel LCD display, if a 640 pixel by 480 pixel resolution is chosen, for example, to drive an external LCD projection panel as a SIMULSCAN™ output, then the LCD output must either be "centered" as described earlier or otherwise accommodated.

High resolution LCD projection panels with color capability may also present problems when attempting to run in high resolution mode. Some projection panels may operate at a resolution of 640 pixels by 480 pixels. Problems related to centering may occur on a high resolution LCD panel when 640 pixels by 480 pixels resolution is set for the projection panel. So-called "multimedia" presentations have become increasingly popular. These presentations usually, as the name implies, use a variety of media (e.g., sound, image, video or the like) to make an information presentation such as a sales promotion, or educational lecture. For a travelling lecturer, a powerful lap-top or notebook computer, coupled to a portable LCD projector screen and overhead projector may provide a dynamic and effective presentation.

An LCD projector screen can be coupled to an external video port (e.g., VGA, EGA or the like) of most portable computers and, when coupled to an overhead projector, project a display image onto a wall or screen. Other types of LCD projector screens incorporate the projector (e.g., light source, focusing lenses) into one compact unit. Alternately, a large, high resolution monitor can be used to provide a presentation display for a small to medium sized group. A computer allows use of action video and colorful special effects, and in addition avoids typical problems associated with using overhead transparencies.

When such multimedia display equipment is used with conventional portable computers, because of fixed resolution related problems, a single display resolution only may be displayed on both displays (internal or projected) at the same time. In many instances, it may be desirable to project presentation material on an external monitor while displaying other information (e.g., speaker's notes) on an internal display. It may also be desirable to switch between internal and external displays, such that a speaker may preview an image prior to projection display. Furthermore, a need for two video displays containing different images may arise in other situations where computers are used, such as CAD systems, spreadsheets, and word processors. In particular, use of Windows™ may make it desirable to allow a user to open one window (or application) on a first video display (e.g., laptop flat panel display) and open another application on another display (e.g., external monitor). Thus, for example, a user may be able to display a scheduler (daily organizer) program on one display while operating a word processing program on another.

One prior art approach to providing multiple displays with different images driven by one computer has been to provide separate video controllers for each display. In lap-top or notebook computers, however, use of two separate controllers may increase power drain, cost, weight and size. Minimizing power, cost, size, and weight is especially critical in highly competitive notebook computer markets.

Traditional methods to drive two displays involves two signals sharing refresh rates. To faithfully provide two distinct display resolutions, it may be desirable to generate two separate signals for two video displays having different resolutions, pixel depths, and/or refresh rates. For example, it may be desirable to generate two displays in different graphics modes, or one display in a graphics mode and another in text mode. Moreover, two different displays (e.g., flat panel display and CRT) may use refresh rates different from one another. Alternately, one display may provide improved performance operating at a particular refresh rate unavailable for the other display. In the context of upscaling an image to a fixed resolution display however, tractional methods may not be available or may be inefficient.

In some cases, where Windows™ is being run in native mode, different graphics resolutions may be run on an LCD display without a problem. Displaying multiple resolutions is possible in Windows™ native mode by using software drivers which compensate for differences in LCD display capability and desired graphics resolution. The problem associated with a fixed high resolution LCD panel may arise particularly when attempting to run computer games.

For various historical and compatibility reasons most popular computer games are run from DOS. Typical graphics resolution for most games run from DOS may be 640 pixels by 480 pixels. This represents inefficient use of display resolution on an LCD panel capable of displaying 600 pixels by 800 pixels or 1024 pixels by 768 pixels. It would be advantageous to take advantage of full display resolution of high resolution LCD display panels.

Interpolation is a well-known prior art technique used for upscaling video images. In an interpolation scheme, several adjacent pixels in a source video image are typically used to generate additional new pixels. During vertical interpolation of source image data, throughput performance problems may be encountered in a scan line dominant order of storing scheme because vertical interpolation usually requires pixels from different scan lines. Accessing different scan lines may require retrieving data from different pages of display memory forcing a non-aligned or non-page mode read access. A non-page mode read access may require more clock cycles than a page mode access for memory locations within a pre-charged row. Thus average memory access time during vertical interpolation may be much higher than consecutive memory accesses within the same row. High average memory access time during vertical interpolation may result in a decrease in the overall throughput performance of a graphics controller chip.

To minimize number of accesses across different rows, a graphics controller chip may retrieve and store a previous scan line in a local memory element. For example, with respect to FIG. 1, a graphics controller chip may retrieve and store all pixels corresponding to scan line A–B and store retrieved pixels in a local memory located in a graphics controller chip. The graphics controller chip may then retrieve pixels corresponding to scan line C–D, and interpolate using pixels stored in local memory.

In order to generate two video signals having different refresh rates and resolutions, it may be necessary to generate different dot clock frequencies, vertical and horizontal sync signals. In addition, each display output may be capable of generating a MotionVideo™ window using Motion Video Architecture™ (MVA™). Aspects of MVA™ are described, for example in co-pending applications Ser. No. 08/235,764, filed Apr. 29, 1994, entitled "VARIABLE PIXEL DEPTH AND FORMAT FOR VIDEO WINDOWS" now U.S. Pat. No. 5,608,864, and Ser. No. 08/359,315, filed Dec. 19, 1994, entitled "MEMORY BANDWIDTH OPTIMIZATION" now U.S. Pat. No. 5,611,041.

Briefly, Motion Video Architectures™ may allow for generation of a hardware window in a video display displaying data stored in off-screen memory having a different pixel depth then surrounding background display. A hardware window may be a window within a graphical display environment like Windows™, the contents of which are generated directly from hardware as opposed to being generated within a software graphics driver such as a call to Windows™ GDI or other application. For example, while running a Windows™ display in eight bits per pixel (bpp) graphics mode, a hardware MotionVideo™ window may be generated having a different pixel depth such as 16 bits per pixel, or 24 bits per pixel. The pixel depth of the MotionVideo™ window may be generated from a compressed mode (e.g., 4-2-2-YUV, MPEG, Accupak™ or the like). Examples of hardware incorporating Motion Video Architectures™ include the Cirrus Logic GD-5440, -7543, and -7548 graphics controller integrated circuits.

SUMMARY OF THE INVENTION

In a computer system with a fixed resolution panel display, a display controller may be used for outputting at least one of a plurality of different graphics display resolutions to a fixed resolution panel display. Display data may be received by the controller in one resolution, for example 640 pixels by 480 pixels. The display data may be output to a fixed resolution panel which may be at a fixed resolution of 600 by 800 pixels, 1024 by 768 pixels or similar.

A line store buffer may receive and store a scan line of display data and two flip flop elements may be used to delay input of display data to a polyphase interpolator by one clock cycle for the flip flop elements and one scan line cycle for the line buffer respectively. Thus, four adjacent pixels may be input simultaneously into a polyphase interpolator for upscaling in the following manner. Display data generated within core VGA logic may be output to a line store buffer, an input terminal of a polyphase interpolator, and a flip flop element. Flip flop element output may be input to another input terminal of a polyphase interpolator, line store output may be input to yet another input terminal of a polyphase interpolator and another flip flop element. Finally flip flop output associated with line store output may be input to a fourth input terminal of a polyphase interpolator. Thus, four inputs with associated delays, create four pixels horizontally and vertically adjacent being input to a polyphase interpolator which may then upscale graphics data to desired output display resolution. Interpolation may be accomplished using a Discrete Cosine Transform upon input pixels. Interpolation may be used to upscale lower resolution display data to a fixed resolution panel of higher resolution.

The display controller of the present invention may receive vertical scan clock VCLK signal from a digital PLL circuit. Variations in timing between native VCLK timing for a fixed resolution panel and timing for desired resolution may be synchronized in a PLL block. A clock divider circuit may generate new VCLK signals proportional to a ratio between the fixed resolution display panel and a desired display resolution. Control registers may contain values associated with fixed panel resolution and desired resolution leading to simplified interfacing. Rather than developing device drivers, programmers may set registers with values corresponding to desired operating parameters.

Display data may then be output to an analog CRT driver or an LCD panel driver. Control registers within the display controller may be used to store output resolution, input resolution, SIMULSCAN™ mode, and other parameters.

BRIEF DESCRIPTIONS OF THE DRAWINGS

DETAILED DESCRIPTION OF THE INVENTION

The descriptions herein are by way of example only illustrating the preferred embodiment of the present invention. However, the method and apparatus of the present invention may be applied in a similar manner in other embodiments without departing from the spirit of the invention.

Figure 1:
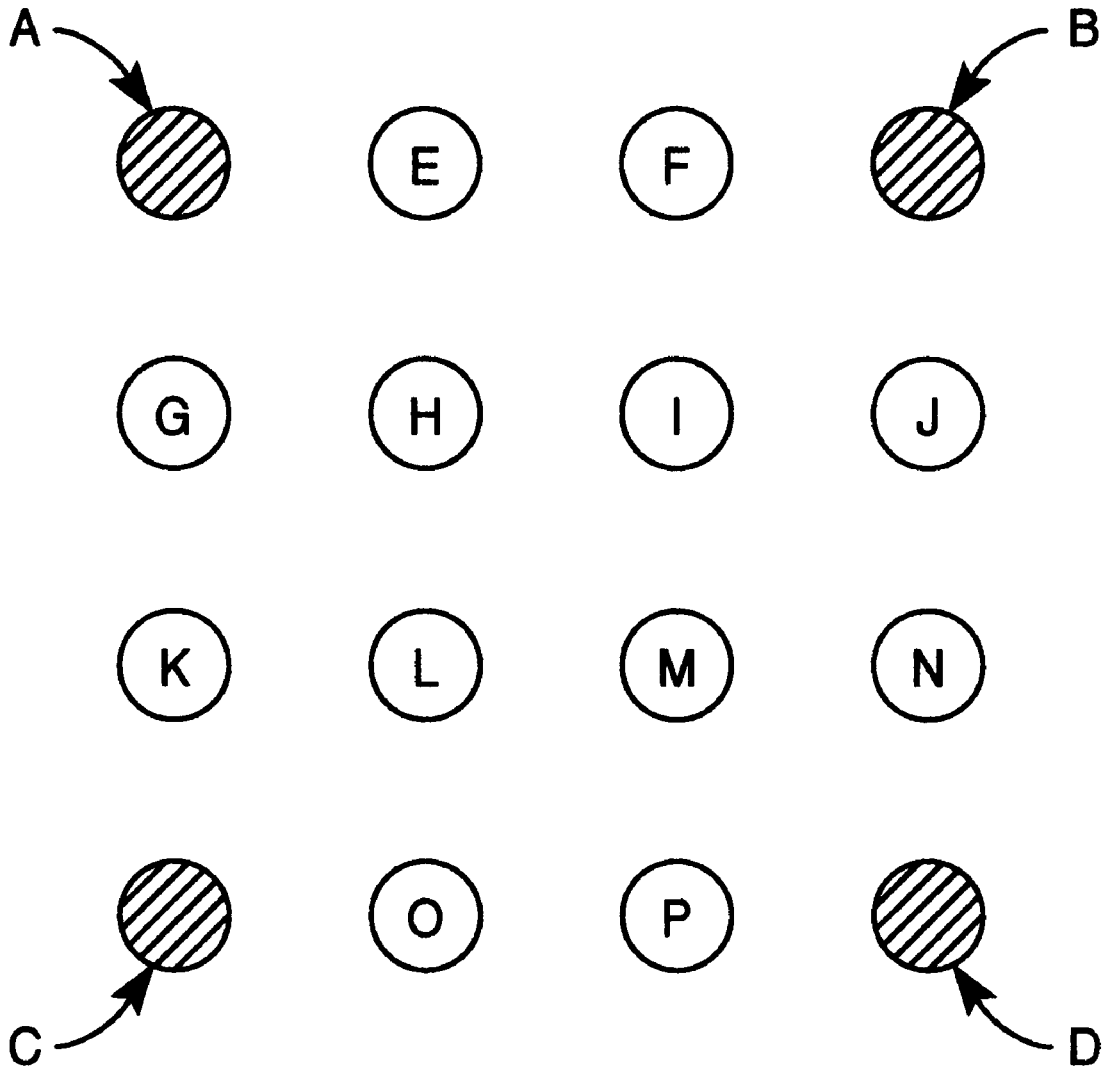
FIG. 1 is a diagram illustrating adjacent source pixels and pixels generated through interpolation.
Figure 2:
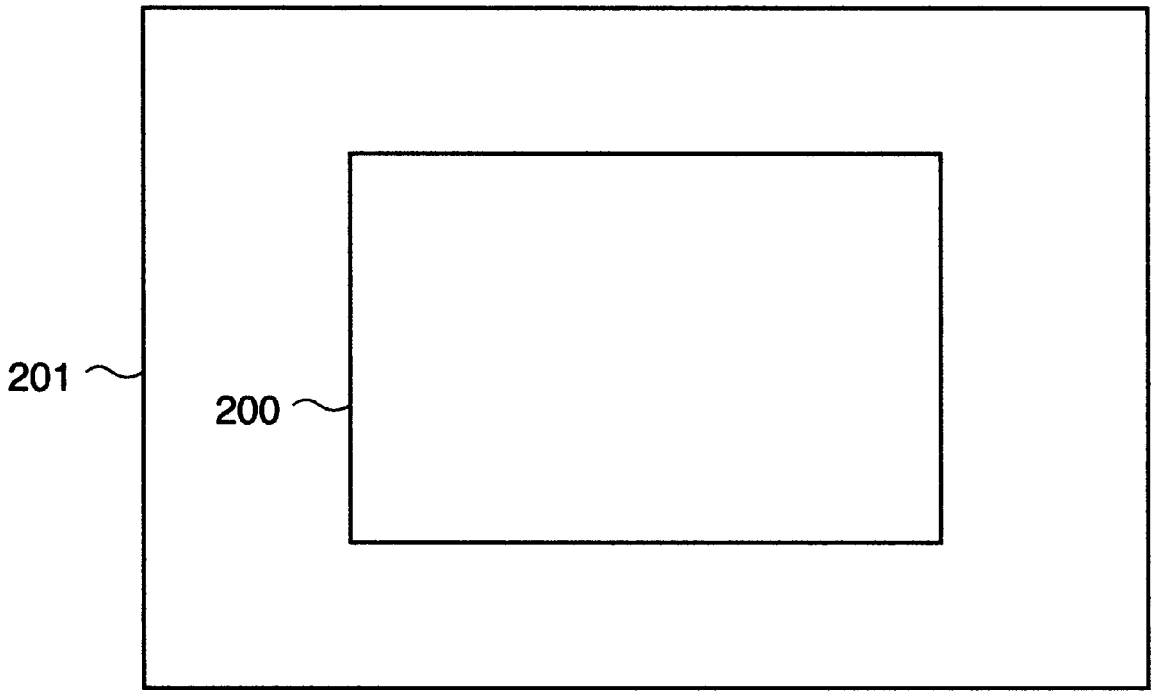
Figure 2 (Prior Art)
FIG. 2 is a diagram illustrating a prior art technique of centering.

FIG. 1 is a diagram illustrating adjacent source pixels and pixels generated through interpolation. FIG. 1 shows pixels (A, B, C, and D) of the original source video image and pixels (E–P) which are generated by interpolation resulting in upscaling the original source video image. Pixel E may be generated, for example, by formula ($\frac{2}{3}$ A+$\frac{1}{3}$ B). If each pixel is represented in RGB format, RGB components of pixel E may be generated by using corresponding components of pixels A, B. Pixel K may similarly be generated using the formula (⅓ A+⅔ C). Generation of pixels such as E, F may be termed horizontal interpolation as pixels E, F are generated using pixels A, B located horizontally. Generation of pixels such as G, K may be termed vertical interpolation.

Figure 3:
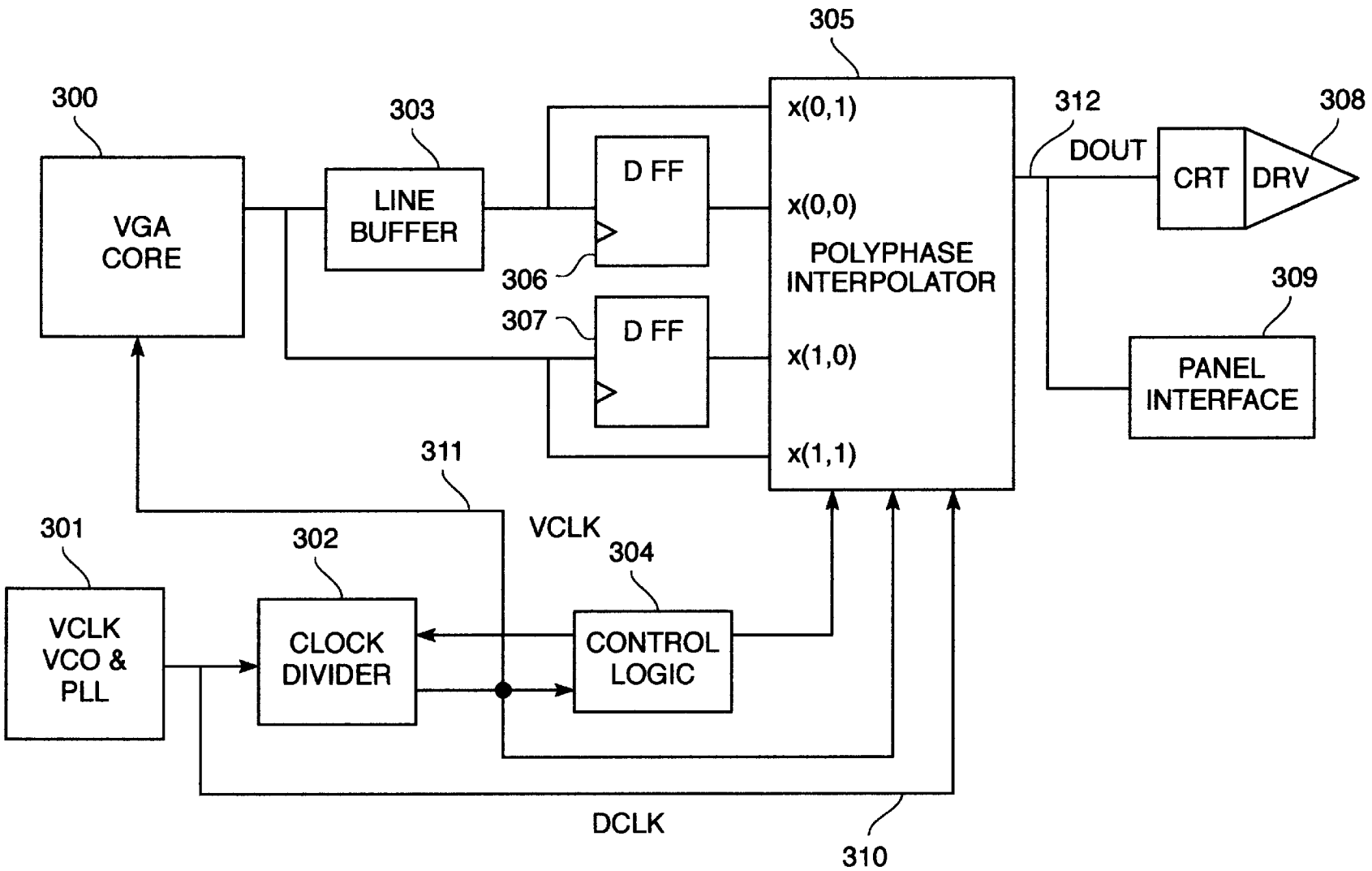
FIG. 3 is a block diagram illustrating components associated with the expansion circuit of the present invention.

FIG. 3 is a block diagram illustrating components associated with the expansion circuit of the present invention. VGA core 300 may generate display data one horizontal line at a time. Horizontal lines are output a pixel at a time at a frequency of VLCK 311 to Line Buffer 303 and D type Flip Flop 307. Line Buffer 303 may store a line of display data and may represent one cycle of delay in the horizontal direction such that Line Buffer 303 may contain the previous line of data. Each D Flip Flop 306 and 307 may add an additional cycle of delay in the vertical direction such that Polyphase Interpolator 305 receives pixels X(0,1), X(0,0), X(1,0), X(1,1). These four pixels represent two adjacent pixels in each horizontal and vertical directions. Pixels generated in Polyphase Interpolator 305, are output to CRT driver 308 and Panel interface 309 which may be used to generated display information on the corresponding display. Polyphase Interpolator 305 and Clock Divider 302 receive DCLK signal 310 from VCLK VCO & PLL block 301. DCLK signal 310 represents the frequency at which data may be generated.

Clock Divider 302 may generate VCLK 311 at a value which represents a ratio between $H_{sizeVGA}$ and $H_{sizeLCD}$. Thus, the ratio between $H_{sizeVGA}$ and $H_{sizeLCD}$ may be proportional to the ratio between DCLK 310 and VCLK 311. The ratio of VCLK 311 and DCLK 310 may automatically set output scaling for the display. Control Logic 304 may store values corresponding to fixed display resolution and desired display resolution. By making values for fixed resolution and desired resolution settable in registers, output resolution is decoupled from a hardware implementation in core logic. Rather than write complex drivers on an individual basis for each display likely to be encountered, developers may simply set values in registers to drive displays of many types including fixed resolution displays. Polyphase Interpolator 305 may generate display lines automatically scaled to fit output size. Control Logic 304 may distribute control signals associated with register settings to VCLK VCO & PLL block 301.

Figure 4:
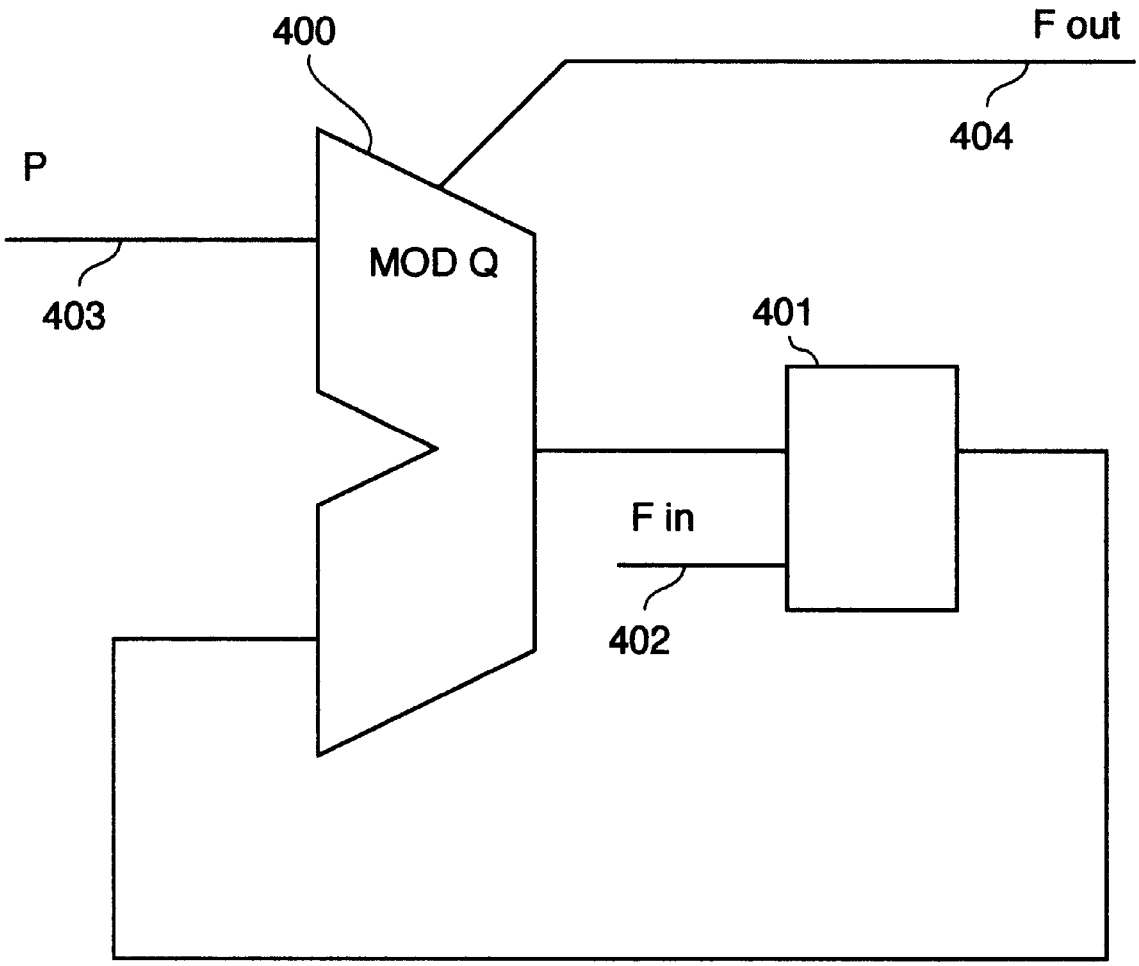
FIG. 4 is a diagram illustrating an embodiment of a Discrete Time Oscillator of the present invention.

FIG. 4 is a diagram illustrating an embodiment of a Discrete Time Oscillator of the present invention. In order to implement VCLK VCO & PLL block 301 and Clock Divider 302 of the present invention, a circuit of the kind illustrated in FIG. 4 may be used to perform a PLL function as well as a divide function. As background to FIG. 4, equation (1) describes the relationship between values P 403, Q, $F_{in}$ 402 and $F_{out}$ 404 of FIG. 4:

$$f_{out}=f_{in}(P/Q) \quad (1)$$

Value P 403 is input to accumulator 400. Value P 403 represents the numerator of the rational expression on the right side of equation 1. Value P 403 may be proportional to the desired output frequency $F_{out}$ 404. Denominator Q may be proportional to the input frequency $F_{in}$ 402. In the preferred embodiment of the present invention, P 403 and Q may be proportional to vertical clock frequencies of desired display resolution and native display resolution respectively. Native display resolution means fixed panel display resolution. $F_{in}$ 402 may be input to the clock terminal of gate 401 which in the preferred embodiment may be a flip flop. The count output of accumulator 400 may be input to gate 401. By indirectly coupling $F_{in}$ 402 through gate 401, anomalies associated with dividing are minimized. As the count increments to value P 403 on each clock transition of $F_{in}$ 402, carry out value representing mod Q is output as $F_{out}$ 404.

Figure 5:
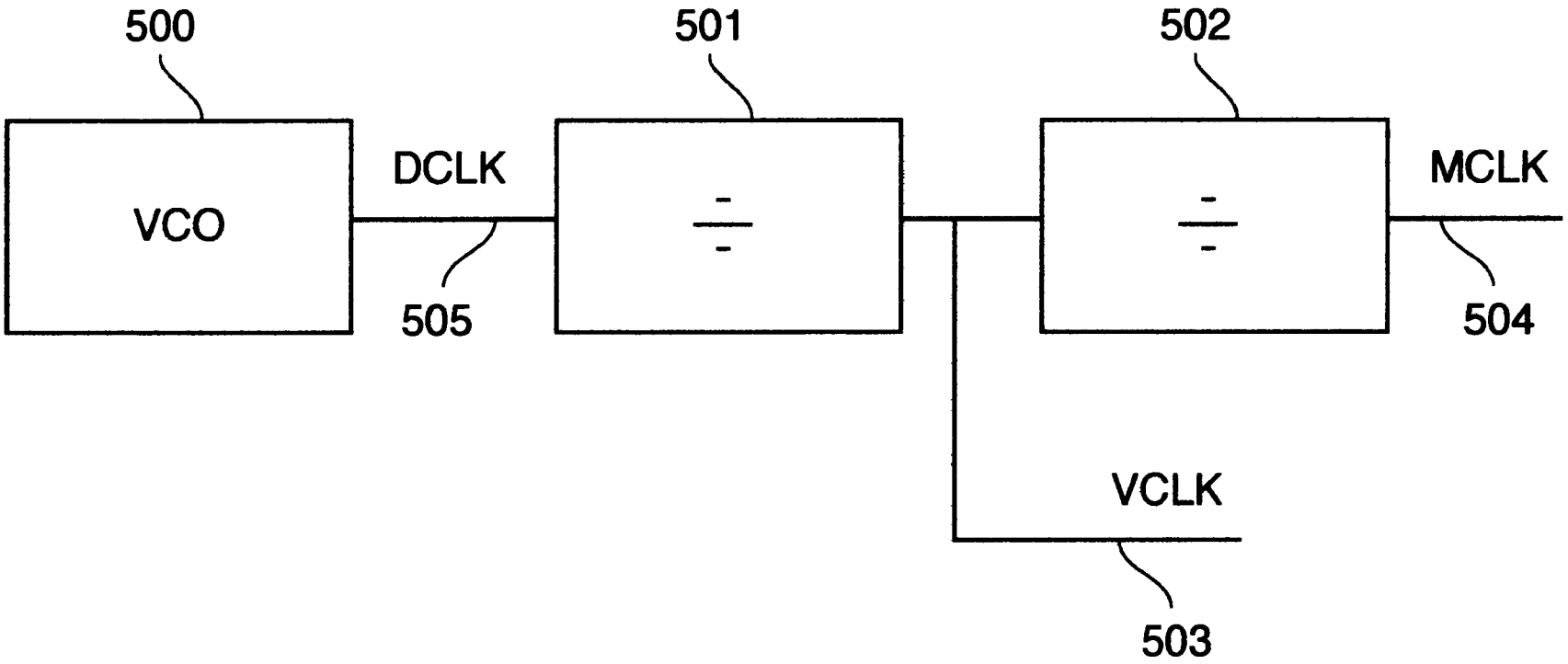
FIG. 5 is a block diagram illustrating a VCO and clock dividers.

FIG. 5 is a block diagram illustrating a VCO and clock dividers. VCO 500 may generate DCLK 505 at a native frequency proportional to the scanning frequency for a fixed panel LCD which may be in use. DCLK 505 may be input to DTO divider 501 for generation of VCLK 503 according to a ratio P/Q as in equation (1). Ratio P/Q may represent the relationship between desired output frequency, which may be proportional to output resolution, and input frequency represented in this embodiment by DCLK 505, which may be proportional to a fixed resolution. VCLK may be output from DTO divider 501 at a frequency proportional to ratio P/Q as in equation (1) and input to DTO divider 502 and other circuits within the controller of the present invention. DTO divider 502 may be used to generate MVA™ clock MCLK 504. MCLK 504 may be used to further scale an MVA™ window within the main scaled graphics display. Since MVA™ window size may be changed during use and since color depth of an MVA™ window may be greater than background color depth, separate "scaling within scaling" must be performed for MVA™ display.

While the preferred embodiment and alternative embodiments have been disclosed and described in detail herein, it may be apparent to those skilled in the art that various changes in form and detail may be made without departing from the spirit and scope of the invention. For example, while interpolation in the preferred embodiment may comprise a Discrete Cosine Transform, the present invention could be practiced with virtually any interpolation means. Moreover, although the preferred embodiment is drawn to an integrated circuit, the present invention may be applied to a series of integrated circuits, a chipset, or in other circuitry within a computer system without departing from the spirit and scope of the present invention.

We claim:

1. In a computer system, a display controller for controlling output of image data in a first pixel resolution to at least one fixed pixel resolution panel display having a second pixel resolution, said display controller comprising:

a clock signal generating means, for generating a first clock signal corresponding to the first pixel resolution;

storage means for receiving and storing image data and outputting the image data stored in said storage means;

interpolator means coupled to said storage means and said clock signal generating means for upscaling the image data from the first pixel resolution to the second pixel resolution corresponding to a resolution of the fixed resolution panel display;

control means coupled to said storage means and said interpolator means for outputting control signals for controlling upscaling of the image data; and at least one clock divider means coupled to said control means, said clock signal generating means, and said interpolator means for receiving a first clock signal and for receiving the control signals output from said control means and for outputting a second clock signal to said interpolator in response to said control signals, said second clock signal output according to a predetermined ratio of an element of the first pixel resolution to an element of the second pixel resolution.

2. The display controller of claim 1, wherein said storage means further comprises a line buffer and at least two flip flops for storing pixel values.

3. The display controller of claim 1, wherein said interpolator means further comprises a polyphase interpolator coupled to said storage means for receiving pixel values for at least four adjacent pixels.

4. The display controller of claim 3, wherein said interpolator means further comprises a polyphase interpolator coupled to said storage means using Discrete Cosine Transform interpolation.

5. The display controller of claim 1, wherein said control means further comprises at least one register means for storing a predetermined ratio corresponding to a present input resolution and a desired output resolution for the graphics display data.

6. A method of controlling output of graphics display data in a computer system, said method comprising the steps of:

dividing at least one input clock signal according to a predetermined ratio between a first and at least one second resolution to produce a second clock signal, receiving graphics display data at the first resolution, interpolating graphics display data from the first resolution to the at least one second resolution using a polybhase interpolator clocked by the first clock signal and the second clock signal, and outputting graphics display data at the at least one second resolution.

7. A computer comprising:

a processor having core logic, primary and secondary memory, and at least one system bus, a flat panel display coupled to said processor for displaying graphics and text output, and a display controller coupled to said processor and said flat panel display for receiving image data at a first resolution, and controlling output of image data in a second pixel resolution corresponding to the flat panel display, said display controller comprising:

a clock signal generating means, for generating a first clock signal corresponding to the first pixel resolution;

storage means for receiving and storing image data and outputting the image data stored in said storage means;

interpolator means coupled to said storage means and said clock signal generating means for upscaling the image data from the first pixel resolution to the second pixel resolution corresponding to a resolution of the fixed resolution panel display;

control means coupled to said storage means and said interpolator means for outputting control signals for controlling upscaling of the image data; and at least one clock divider means coupled to said control means, said clock signal generating means, and said interpolator means for receiving a first clock signal and for receiving the control signals output from said control means and for outputting a second clock signal to said interpolator in response to said control signals, said second clock signal output according to a predetermined ratio corresponding to a ratio of an element of the first pixel resolution to an element of the second pixel resolution.

8. The computer of claim 7, wherein said storage means further comprises a line buffer and at least two flip flop elements for storing pixel values.

9. The computer of claim 7, wherein said interpolator means further comprises a polyphase interpolator coupled to said storage means for receiving pixel values for at least four adjacent pixels.

10. The computer of claim 7, wherein said interpolator means further comprises a polyphase interpolator coupled to said storage means using Discrete Cosine Transform interpolation.

11. The computer of claim 7, wherein said control means further comprises at least one register means for storing a predetermined ratio corresponding to a present input resolution and a desired output resolution for the graphics display data.

* * * * *